US005544750A

United States Patent [19]

Randall

[11] Patent Number: 5,544,750

[45] Date of Patent: Aug. 13, 1996

[54] PORTABLE HOLDER FOR TISSUES

[76] Inventor: Carol C. Randall, 1242 Redondo Blvd., Los Angeles, Calif. 90019

[21] Appl. No.: 432,784

[22] Filed: May 2, 1995

[51] Int. Cl.[6] ..... B65D 83/08

[52] U.S. Cl. ..... 206/494; 150/131; 206/37; 206/457

[58] Field of Search ..... 150/132, 138, 150/139, 131, 143, 145, 146, 149; 206/37, 38, 38.1, 39, 233, 449, 450, 494, 812, 457

[56] References Cited

U.S. PATENT DOCUMENTS

| | | | |
|---|---|---|---|
| D. 261,826 | 11/1981 | Webb | D3/39 |
| 840,661 | 1/1907 | Rood | 150/139 |
| 1,522,220 | 1/1925 | Wood | 206/1925 |
| 1,545,577 | 7/1925 | Arms | 150/145 |
| 1,883,852 | 10/1932 | Medoff | 206/449 |
| 1,953,887 | 4/1934 | Medoff | 206/37 |
| 2,737,991 | 3/1956 | Bass | 150/132 |
| 4,331,194 | 5/1982 | Lederer | 206/37 |

*Primary Examiner*—Jimmy G. Foster

[57] ABSTRACT

A portable holder for tissues to carry full size tissues right from a tissue box. The holder is to be die cut from flexible transparent material such as vinyl. The holder has having two like pockets on interior surface so aligned as to create a channel for the insertion of an insert cut to fit the rectangular main body of holder for tissues. Transparency of holder allows the insert to be seen through holder thereby becoming the decor of holder. With the insert in place, tissues are placed over the insert, the holder is folded and the fastener is secured.

2 Claims, 2 Drawing Sheets

PORTABLE HOLDER FOR TISSUES

BACKGROUND-FIELD OF INVENTION

This invention relates to tissue holders, specifically to an improved portable holder for full size tissues with an innovative means for decoration or advertising.

BACKGROUND-RELATED INVENTION

A prior U.S. Design Patent U.S. Pat. No. DES 261,826 (Webb) was issued on Nov. 17, 1981 (Webb was my previous name before marriage.) In March, 1995 I redesigned the tissue holder and on Mar. 20, 1995 I filed a Disclosure Document #372913.

BACKGROUND

Presently the popular way to carry tissues is to buy "tissue packs", a package of small folded tissues enclosed in a plastic packet, and carry them in pocket or purse for future use. The disadvantage of these tissue packs is the small size of the tissues, the small number of tissues and the fact that the packaging quickly deteriorates exposing the tissues which become soiled before use. Also these packs are not refillable and you must constantly purchase new ones. Another way that tissues are carried is loose and unprotected, right from the tissue box. Most people who carry tissues take a handful from the box and put them in their pocket or purse where they are quickly soiled and disheveled before they are used. Many people find it helpful and convenient to have tissues on hand to be used in various situations. People with children find them useful for wiping faces and hands or runny noses, people with colds or allergies, travelers and many others carry tissues regularly.

SUMMARY OF THE INVENTION

The invention, a portable holder for tissues, is made from soft transparent vinyl and designed to hold full size tissues right from the tissue box and to be carried in pocket, purse, briefcase etc. Once tissues are placed in the holder, the holder is folded to a compact size, one third the size of a regular tissue. Most people who carry tissues take them from a tissue box and place them in pocket or purse unprotected. Being unprotected, the tissues become unsightly before they are used. The portable holder for tissues solves this problem by furnishing a compact , attractive, refillable vehicle for holding the tissues that keeps them clean until used. The previous tissue holder, Design Patent No. U.S. Pat. No. 261,826 also afforded these same benefits but the new embodiment has a much broader scope. Not only does the tissue holder provide the aforementioned benefits but it also allows for an insert to be displayed across the rectangular main body of the tissue holder. This insert can be an advertisement, art work, a craft, photos etc. The new feature consists of two like pockets positioned on the interior of the tissue holder one on each end of the rectangular main body of the holder. The pockets function is for the insertion of a rectangular insert cut exactly to size to fit the full length and width of the main body of the tissue holder. The insert could be decorative paper, fabric, advertising copy, photos etc. Once the insert is in place, the insert can be seen through the transparent vinyl thereby becoming the decor of the tissue holder. This functional improvement and the ease with which the tissue holder can be changed will allow the holder to be used in an unlimited number of ways such as: advertising specialties, crafts, souvenirs, promotions and many others. This is a great advantage cost wise. Instead of having to imprint the vinyl, which is an expensive process, an insert can be inexpensively printed or decorated and easily inserted into the tissue holder.

BRIEF DESCRIPTION OF THE DRAWINGS

Drawing Figures

Figure 1:
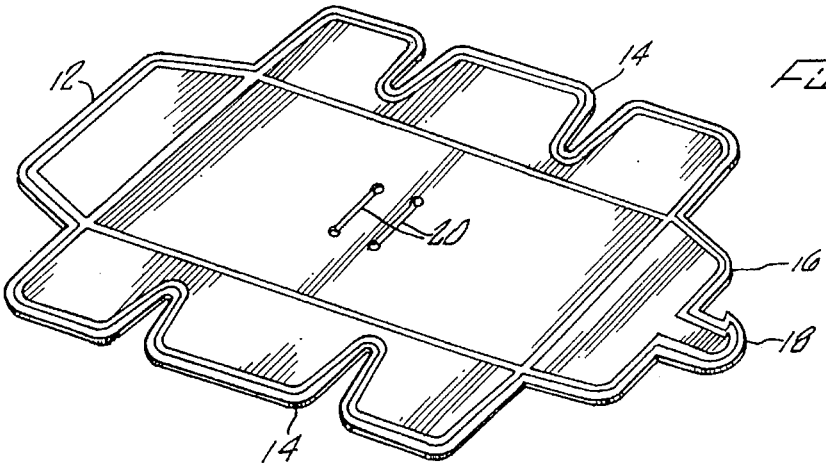
FIG. 1 a perspective view of exterior of unfolded holder for tissues

| Reference Numerals In Drawings | |
|---|---|
| 10 | Pockets for inserts |
| 12 | End flaps |
| 14 | Side notched flaps |
| 16 | Flap with arrow shaped closure |
| 18 | Arrow shaped closure |
| 20 | Double slits |

DESCRIPTION OF THE PREFERRED EMBODIMENT

Description of Invention

Figure 2:
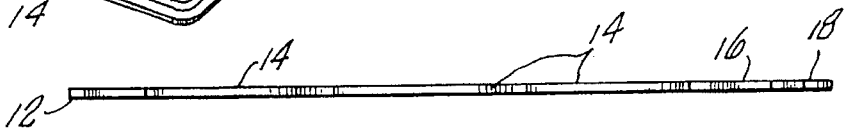
FIG. 2 an end elevational view thereof
Figure 4:
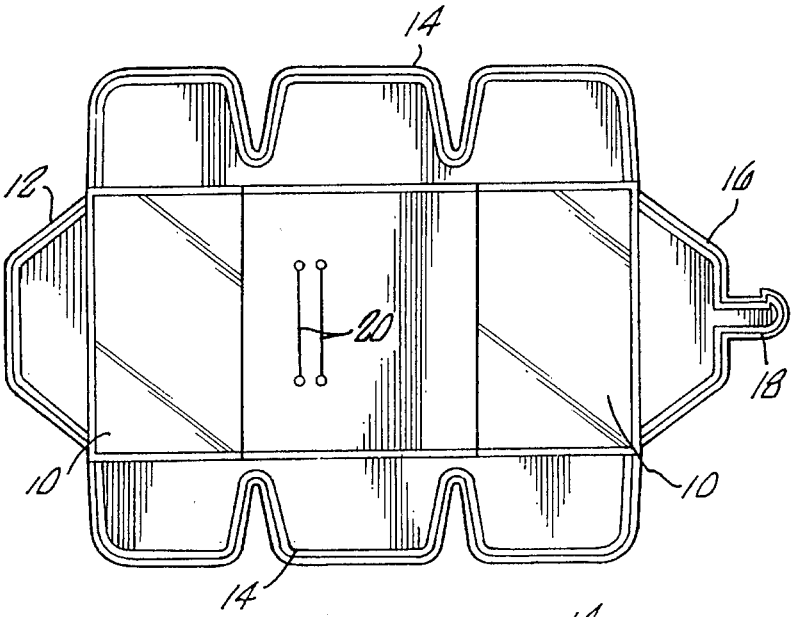
FIG. 4 a perspective view of the interior of unfolded holder for tissues
Figure 3:
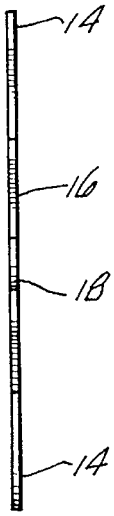
FIG. 3 a side elevational view thereof
Figure 5:
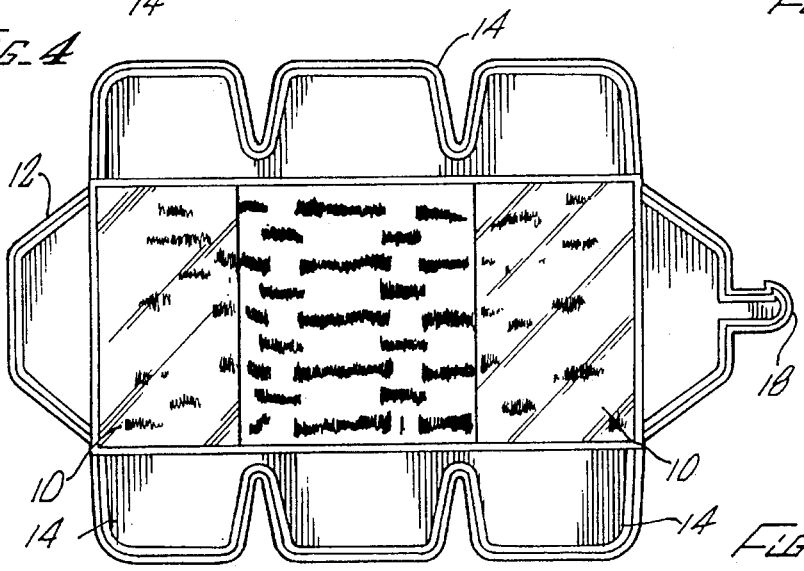
FIG. 5 a perspective interior view of unfolded holder for tissues with cloth insert in place FIG. 6 a perspective interior view of an unfolded holder for tissues with tissues in place over insert FIG. 7 a perspective view of the interior of a holder for tissues in a partially folded condition FIG. 8 an enlarged perspective view of a holder for tissues in closed condition
Figure 6:
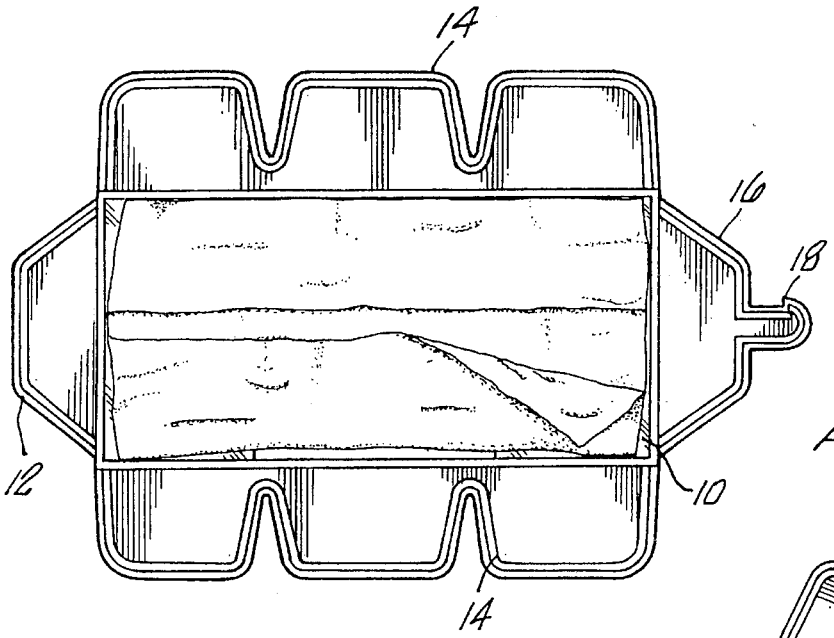
Figure 7:
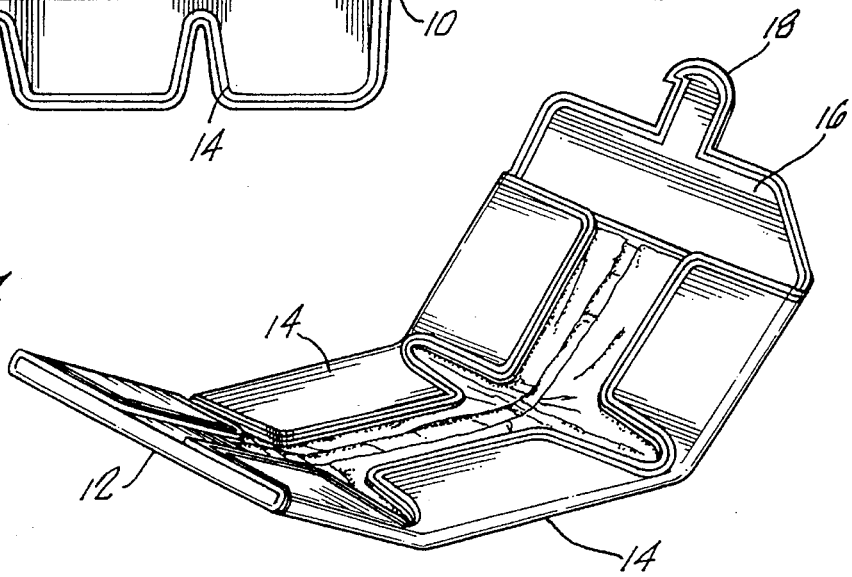
Figure 8:
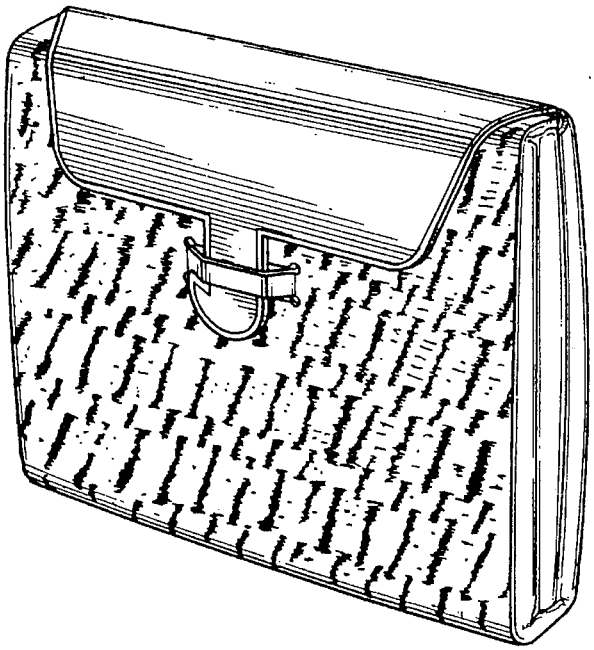

An overall view of the exterior of the portable holder for tissues is illustrated in FIG. 1. FIG. 2 shows an end view and FIG. 3 shows a side view. The portable holder for tissues is die cut in one piece from transparent soft vinyl. FIG. 4 shows a view of the inside of the holder for tissues showing areas 10 where vinyl is in two layers forming pockets with openings facing toward the center of holder for tissues. Also shown in FIG. 4 are double slits 20 used in the closure of the holder for tissues. In the illustration FIG. 5, an insert is seen in place with the ends tucked into pockets 10. In FIG. 6 tissues have been placed over the insert. In FIG. 7 an end flap 12 and notched side slaps 14 have been folded flat against the tissues and the holder for tissues is pictured in a partially folded condition. In illustration FIG. 8 the tissue holder has been completely folded with flap 16 having an arrow shaped closure 18, folded down and arrow shaped closure 18 in place and pushed through double slits 20. The design of the insert may be seen through the transparent vinyl.

OPERATION OF INVENTION

To utilize the portable holder for tissues, the holder is laid flat as in FIG. 4 with the inside facing up. A cut-to-fit insert is placed over the rectangular body of the holder for tissues, and the ends are tucked smoothly into the two like pockets 10. The the tissues are then placed over the insert. The end flap 12 is then folded flush against the tissues then notched side flaps 14 are also folded flush against tissues. The holder for tissues is then folded in thirds starting from the lower end 12. Once folded, flap with the arrow-shaped closure 18 is guided through double slits 20 to secure the holder in its folded condition.

SCOPE

You can see that the portable holder for tissues provides a unique and attractive carrier for tissues with the added benefit of easy personalization. While my above description contains many specificities, these should not be construed as limitations on the scope of the invention, but rather as an exemplification of one prefered embodiment thereof. Other variations are possible. For example: a different type closure, use for something other then tissues i.e. panty liners, travelers checks, currency. Thus the scope of the invention should be determined by the appended claims and their legal equivalents rather than by the example given.

I claim:

1. A portable holder for tissues, said holder being constructed from a transparent flexible material, said holder having a main body portion being rectangular in shape, the rectangular main body portion having like pockets on an interior surface thereof, said pockets being located on opposite ends of said interior surface of said rectangular main body portion, each pocket being sealed on three edges that form the outer perimeter of said rectangular main body portion, each pocket having an opening transverse to the length of said rectangular main body portion, each pocket extending the full width of said rectangular main body portion, said rectangular main body portion containing two like parallel slits, said slits being positioned to act as part of a securing mechanism to affect closure of said holder when said holder is in a folded condition; said holder comprising four flaps, including two like notched side flaps extending from opposite sides of said rectangular main body portion, a third flap extending from one end of said holder and a fourth flap having an arrow shaped extension and extending from an opposite end of said holder, each flap having parallel crease lines at its juncture to said rectangular main body portion.

2. The holder as set forth in claim 1 above, wherein said material is soft vinyl.

* * * * *